US012427378B2

(12) United States Patent
Lee

(10) Patent No.: US 12,427,378 B2
(45) Date of Patent: Sep. 30, 2025

(54) TREE CLIMBING STICK ASSEMBLY AND METHOD OF MANUFACTURE

(71) Applicant: Scott Lee, Frankenmuth, MI (US)

(72) Inventor: Scott Lee, Frankenmuth, MI (US)

( * ) Notice: Subject to any disclaimer, the term of this patent is extended or adjusted under 35 U.S.C. 154(b) by 792 days.

(21) Appl. No.: 17/720,871

(22) Filed: Apr. 14, 2022

(65) Prior Publication Data

US 2023/0330491 A1 Oct. 19, 2023

(51) Int. Cl.
*A63B 27/00* (2006.01)

(52) U.S. Cl.
CPC ..... *A63B 27/00* (2013.01)

(58) Field of Classification Search
CPC ..... A63B 27/00; A63B 27/02; A63B 27/04; A63B 22/00; E06C 1/381; E06C 1/34; A01M 31/02
See application file for complete search history.

(56) References Cited

U.S. PATENT DOCUMENTS 4,611,945 A * 9/1986 Diego ..... F16C 11/10 403/96
5,109,954 A * 5/1992 Skyba ..... E06C 1/10 182/189
6,959,784 B2 * 11/2005 Diggle ..... A63B 27/00 280/805
7,775,916 B1 * 8/2010 Mahoney ..... A63B 63/004 403/292
10,973,244 B2 4/2021 Jackson et al.
11,198,038 B1 12/2021 Power, II et al.
11,317,622 B2 * 5/2022 Power, II ..... A01M 31/02
11,808,085 B2 * 11/2023 Power, II ..... A63B 27/00
2016/0024843 A1 * 1/2016 Niemela ..... E06C 1/10 182/189
2021/0259424 A1 * 8/2021 Tsai ..... A47C 7/004
2022/0025702 A1 * 1/2022 Hebert ..... E06C 7/082
2022/0025703 A1 * 1/2022 Barker ..... E06C 1/14
2023/0228149 A1 * 7/2023 Schofield ..... E06C 1/34 182/189
2023/0397600 A1 * 12/2023 Schofield ..... A01M 31/02

* cited by examiner

*Primary Examiner* — Beth A Stephan
(74) *Attorney, Agent, or Firm* — Robert L. Stearns; Dickinson Wright PLLC

(57) ABSTRACT

A tree climbing stick includes a tubular post having upper and lower end portions. Upper and lower standoff-step components include mounting collars which are disposed about the upper and lower end portions. Retaining plugs are disposed into the upper and lower end portions opposite the mounting collars and support the end portions and cooperate to prevent the end portions from moving inward or outward to maintain a tight fit of the joint in use when subjecting to bending loads.

21 Claims, 7 Drawing Sheets

TREE CLIMBING STICK ASSEMBLY AND METHOD OF MANUFACTURE

BACKGROUND OF THE INVENTION

1. Technical Field

This invention relates generally to tree climbing sticks used for climbing the trunk of a tree.

2. Related Art

Tree climbing sticks, or simply, climbing sticks, are used by outdoor enthusiasts for scaling trees. For example, a day hunter may temporarily secure one or several climbing sticks up the trunk of the tree in order to access an elevated tree stand or platform. Such climbing sticks are designed to be portable and typically are carried into the woods by the hunter, installed on the tree to be climbed, and then removed after the day hunt. As such, climbing sticks are available in a variety of shapes and sizes geared toward portability and ease of use. Most climbing sticks include a central post (the "stick") which extends between top and bottom ends and mounts a set of tree-engaging standoffs and foot-engaging steps at each end. A user secures the climbing stick to the tree by bracing V-shaped jaws of the standoffs against the trunk and then wrapping a line about the backside of the tree and cinching it to one or more attachment brackets fixed to the post.

The central post of a climbing stick is usually made of sturdy tubular stock, such as square steel or aluminum tubing, and the wall thickness is sufficiently thick to resist flexing of the post under the weight of a user when climbing the steps. Such robust posts, however, are heavy and some users find the weight objectionable especially when having to carry several climbing sticks into and out of the woods during a day hunt with each stick weighing several pounds.

U.S. Pat. No. 11,198,038, discloses a tree climbing stick that corresponds closely to a climbing stick sold by Tethrd, Inc. under the brand name "Tethrd One" and which is illustrated in FIGS. 1-3 as prior art in this application. This prior art climbing stick 10 has a central post 12 fabricated of thin-walled round titanium alloy. Unitized standoff-step components 14 are provided at upper 16 and lower 18 end portions of the tube 12 and each has a mounting collar 22 formed with a bore 20 that is machined to receive the outer wall surface of the tube ends 16, 18 with a very close fit. The standoff-step components 14 are machined of aluminum alloy, and thus are of a different material than that used for the post 12. A bonding agent or some type of adhesive is also reported as having been used at the collar-tube joint interfaces. Retention pins 24 are pressed into aligned cross bores of the collars 22 and end portions 16, 18 to assist in securing the standoff-step components 14 to the post 12. An attachment bracket 26 is provided below the upper standoff-step component 14 at a location about ⅓ way down the post 12 to enable a user to loop a rope or cable about the trunk of a tree T and then tie it off on the bracket 26, with jaws 28 of the standoff-step portions 14 cradling the tree and supporting the post 12 and step portions spaced outward from the tree.

This prior art Tethrd One climbing stick is reported as being very light weight, with each climbing stick said to weigh less than one pound. The reduced weight is achieved in part by using thin-walled titanium alloy tubing for the post 12 and precision-machined aluminum for the standoff-step-collar components. Literature states that the alloy used for the tubing is Grade 9 TI-3Al-2.5V aerospace seamless titanium tubing, and has been observed to have an outer diameter of about 1 inch and a wall thickness of about 0.04 inches, giving it a very high diameter-to-wall thickness ratio in the range of 25:1. It has been observed that the titanium tubing of this product, while extremely light and very hard and stiff in hand, nonetheless bends and flexes noticeably under load when a user places his or her body weight on the steps, but then recovers when the load is removed. In fact, the tube has been observed to flex elastically inward toward the tree by as much as much as 1 inch or more about midway between the top and bottom step when under load. It has also been observed that the joint connection between the collars 22 and tube ends 16, 18 can loosen after flexing, causing the stand off-step components 14 to rock on the post 12 under load, which may give the stand off-step components 14 a slightly unstable or wobbly feel that a user might find objectionable. It has further been observed that the degree of tilting of the components 14, when the right or left step of the components 14 is loaded, exceeds the overall bending of the tube 12, meaning that there is further localized deformation of the end portions 16, 18 near the collars 22 beyond the overall bend in the middle of the tube 12. The tilt angle of the steps is illustrated schematically in FIG. 2 as being exaggerated for illustration purposes, with the true tilt angle being observed in range of about 5 to 20 degrees depending on the magnitude of the load and the looseness of the joint. It has been observed that the wall of the end portions 16, 18 elastically deforms inward on the loaded side of the tube corresponding to the left or right step that is being loaded at any given time, evidencing that the end portions 16, 18 elastically buckle inwardly of the collars 22 when under heavy bending load. As illustrated in FIGS. 2 and 3, this localized deformation of the end portion walls 16, 18 pulls the deformed wall portion inwardly and out of contact with the bore wall of the collar 22 that is supporting the step, leaving a visible gap 29. The inward deformation appears to occur on the side bearing the inward force of the bending load, illustrated as the load applied to the right-hand step in FIG. 2. The same gap appears on the other side when left-hand step is loaded. The repeated back-and-forth rocking of the left and right steps under load and the corresponding inward flexing of the end portions 16, 18 away from the collar wall to create the opening and closing gaps 29 is believed to compromise the integrity of the original tight fit joints, giving the steps the objectionable loose feel over time. It is also observed that the support of the post 12 and collars 22 outward of the tree by the jaws 28 of the stand off-step components 14 imparts a downward racking/bending load at the collar-post interface as the jaws 28 grip the tree and urge the steps and post downward under the weight on the user. This may add to the localized flexing of the end portions 16, 18 within the joint.

The dissimilar materials used for the tube and standoff-step-collar components as well as the relative thinness of the tube/thickness of the collars make the option of welding parts together extremely difficult and commercially impractical. Adhesives and bonding agents also appear not to suffice as evidenced by the loosening of the joints due to the extreme flexing of the end portions within the joint under load. Selecting a different tube (e.g., heavy-walled steel) that could withstand the bending load without flexing in the joint would not be feasible since the one-pound weight threshold would necessarily be sacrificed. The prior art approach to securing the steps on the tube in a lightweight construction is thus faced with many challenges under difficult and dynamic loading conditions, attributed in part to material selection, geometries and practical or commercial restrictions of the present feasible options.

It is an object of the present invention to provide a lightweight climbing stick that does not suffer from the deficiencies of the stick described above, and particularly improving the integrity of the tube-step joints.

SUMMARY

A tree climbing stick assembly includes a central tubular post that extends between opposite ends and is flexible in use under a bending load. At least one step is supported on the post at a joint. At least one stabilizing member is disposed within the tubular post in position to stabilize joint by restricting inward flexing of the tubular post at the joint.

According to a preferred embodiment, the step has a mounting collar portion which engages the outer surface of the tubular post at the joint to restrict radial outward flexing of the tube wall within the joint when under a bending load. The stabilizing member is disposed within the tube opposite the collar and acts to restrict radial inward flexing of the tube wall within the joint under the bending load. The preferred combination effectively immobilizes radial movement of the tube wall within the joint and improves the tightness and integrity of the step-tube joint over time by stabilizing the tube so there is no radial flexing in the joint when bending loads are imparted on the joint by a user stepping on a right or left side of the step that is cantilevered from the post.

According to a further aspect, an improved climbing stick has a post made of lightweight, thin-walled tubing, such as titanium, aluminum, magnesium, carbon, resin fiber, or steel and has end portions which flex radially inward under a bending load. At least one step is supported on at least one of the end portions at a joint and extends from the tube in cantilevered fashion such that when a load is placed on the step it imparts a bending load to the post. The inside of the tube is reinforced by a stabilizing member disposed within the tube in position to support the tube wall against inward flexing thus stabilizing the joint under the bending load.

According to a further aspect, the stabilizing member takes the form of a rigid plug that has a hoop strength exceeding that of the wall of the tubular post so that the plug supports the wall of the tube under the bending load without the wall and plug flexing inward under the load. The rigid plug is further preferably solid in cross section along at least part of its length.

THE DRAWINGS

This and other features and advantages will become better understood when considered in connection with the detailed description and appended drawings, in which.

Figure 12:
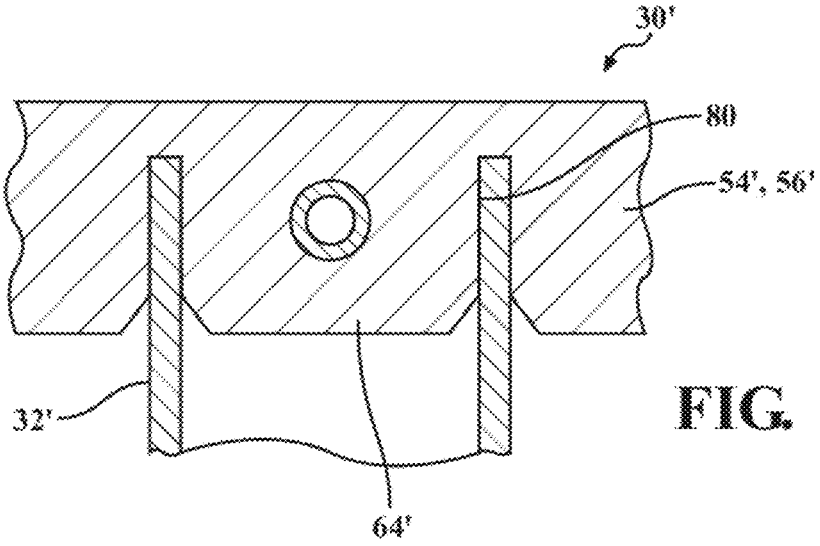
Figure 13:
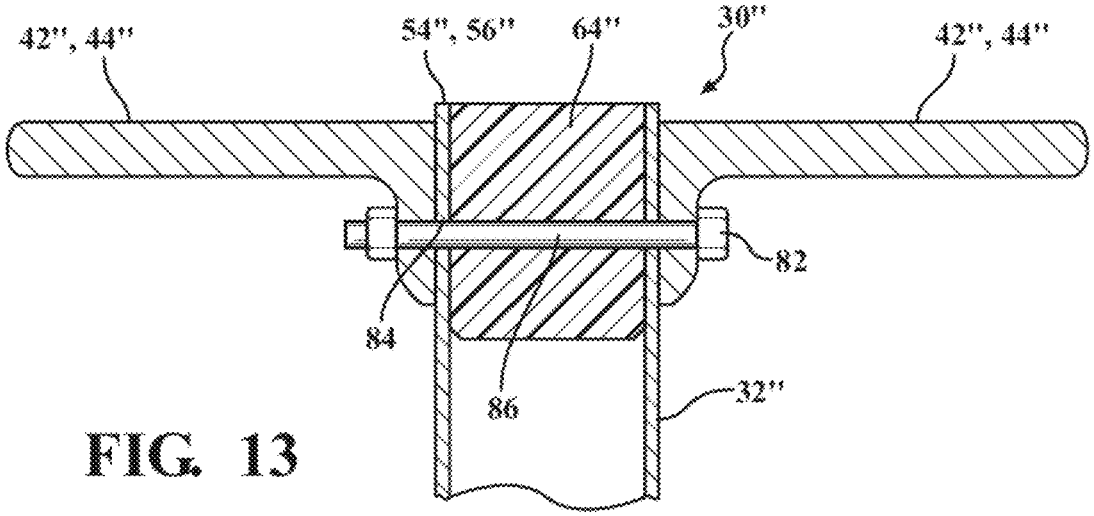

FIG. 12 as an enlarged fragmentary cross-sectional view of another alternative embodiment;

FIG. 13 is an isometric view of an alternative stabilizing plug; and

Figure 14:
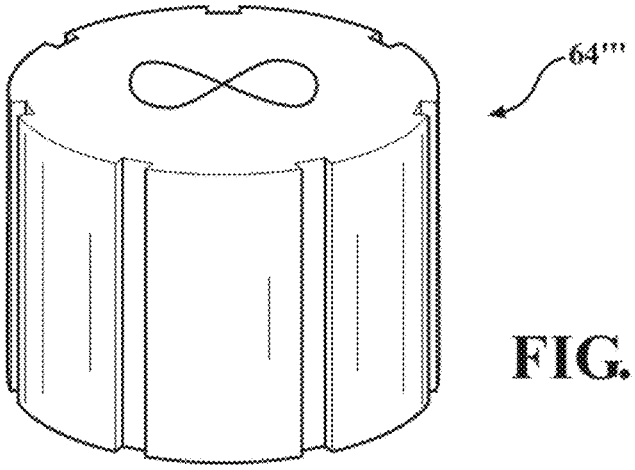

FIG. 14 is an isometric view of an alternative stabilizing plug.

DETAILED DESCRIPTION

Figure 4:
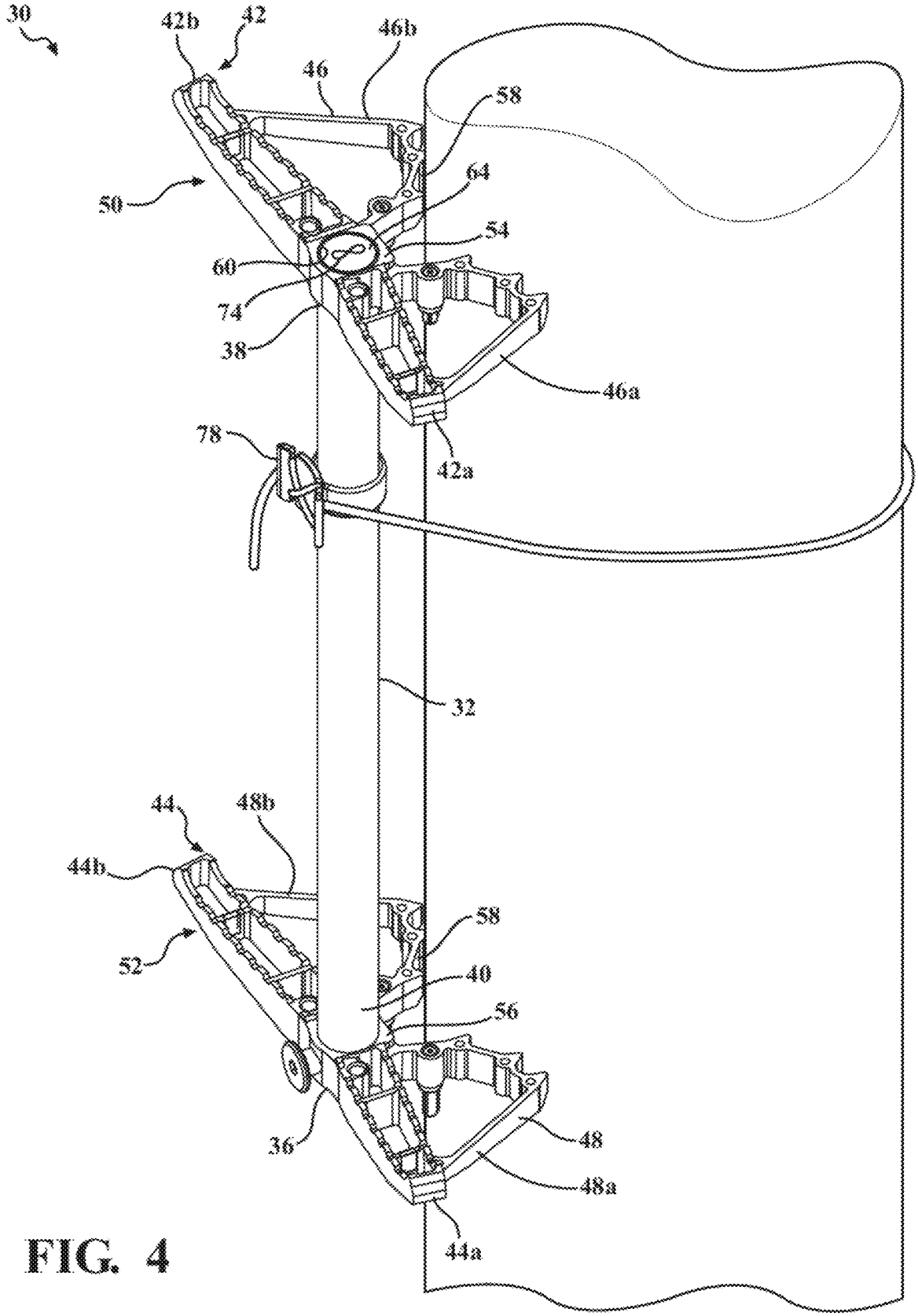
FIG. 4 is a perspective view of a tree climbing stick according to a preferred embodiment shown secured to a tree.
Figure 5:
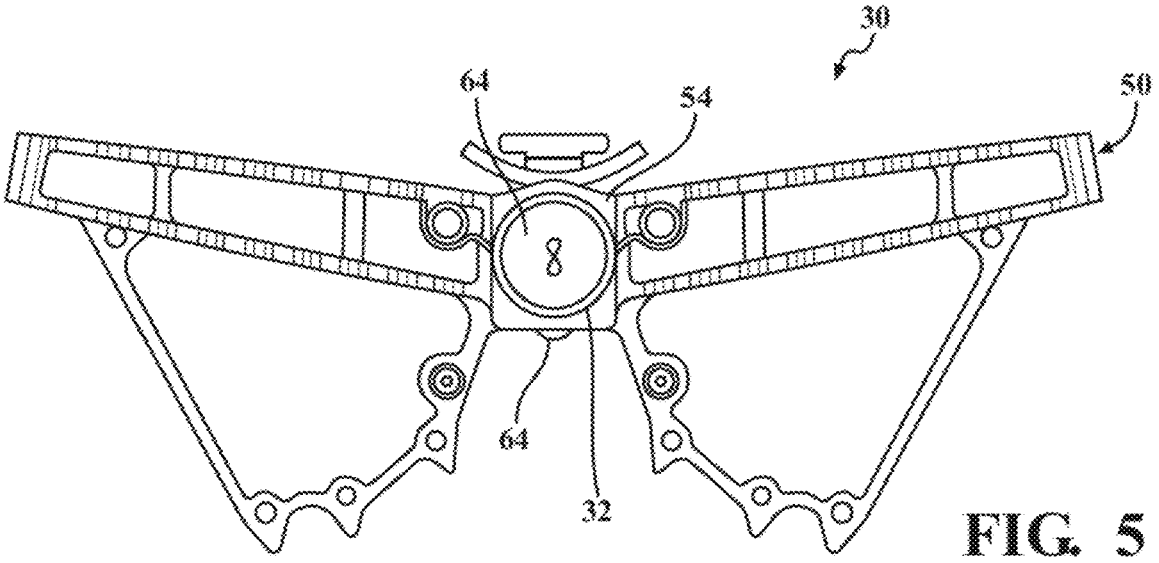
FIG. 5 is a top view of the tree climbing stick of FIG. 4.

FIG. 4 illustrates an embodiment of tree climbing stick, or climbing stick 30. The climbing stick 30 includes a main or central post 32 that extends longitudinally between opposite ends 34, 36. The post 32 is tubular in construction and includes open-ended tubular end portions 38, 40 adjacent the post ends 34, 36, respectfully.

The tubing of the post 32 may be made of metal such as steel, aluminum, titanium, magnesium, etc., or it may be made of a non-metallic material such as carbon fiber tubing. It will be understood that reference to tubing materials or that of other components includes alloys of these materials, such that reference to a titanium, steel, magnesium or aluminum tube or component encompasses their alloys.

The wall thickness of the tubing 32 is selected to provide sufficient strength to the post 12 to support the weight of a user that may impart various loads and stresses on the post 32. The material selection and wall thickness of the tube 32 may also be factored by the desire to produce a light weight climbing stick 30, for example one with a total weight of 1 pound or less. These various factors may yield a tubular post 32 that is sufficiently strong to support the weight of the user, but nonetheless may elastically bend and flex under load in various ways depending on how the forces are applied. As such, it is contemplated that the wall of the tubing may be strong and stiff, but yet flexible, such that the wall of the tube may tend to flex inwardly or outwardly including at the end portions 38, 40, and the post 32 may bend and flex intermediate its ends 34, 36. Thin-walled titanium alloy tubing is such a material, including Grade 9 TA-18, Ti-3Al-2.5V tubing which may be a preferred material. It has a very high strength-to-weight ratio relative to steel or aluminum. It is very light weight (40% lighter than steel), very strong (twice as strong as aluminum) and very durable. Even so, such thin-walled titanium tubes flex under the compression and bending loads when used as the post for a climbing stick. Thin-walled steel and aluminum may also flex, as may other materials including carbon fiber tubes. By thin-walled, it is meant that the material and wall thickness of the tube is sufficiently strong to support the weight of the user and the loads and forces applied to the tube during extended use, but with attention also to weight minimization in an effort to produce a strong but light weight climbing stick. For example, and according to a preferred embodiment, a length of Grade 9 TA-18 titanium tubing may be used having a length of about 457 mm with a nominal outer diameter of 25.4 mm and a nominal inner diameter of 24.6 mm, yielding a nominal wall thickness of about 0.9 mm.

An additional challenge with light-weight, thin-walled tubing materials, such as titanium, is that the manufacturing tolerances of commercially available product are not true to shape. In other words, round titanium tubing is typically not perfectly round and may actually be significantly out-of-round so it tends toward oval. In the above example, the 25.4 mm OD and 24.6 mm ID represent an average, when in fact there are likely irregularities or variations about the circumference. The wall thickness is generally uniform, but there may be slight variations in surface texture due to manufacturing (e.g., die lines from extrusion). Steel, aluminum and carbon fiber tubing may experience similar shape discrepancies. While various cross-sectional shapes of the post 32 are contemplated (e.g., round, square, rectangular, hexagonal, etc.) round or circular is preferred as it yields the least amount of material and lends to reduced weight and cost. The misshapen tubing tends to be generally uniform along its length, such that the end portions 38, 40 may be similarly misshapen prior to assembly with the other components to be described.

The climbing stick 30 further includes at least one step 42 preferably located adjacent one of its ends 34, 36. It is more preferred that there are at least two steps 42, 44 and that an upper one 42 of the steps is provided adjacent the upper end 34 of the post 32, and that a lower one 44 of the steps is provided adjacent the lower end 36. It is still further preferred that the upper and lower steps 42, 44 each have left and right foot pads projecting from laterally opposite sides of the post 32 and denoted in the Figures as 42*a*, 42*b* and 44*a*, 44*b*, respectively.

The climbing stick 30 further includes at least one and preferably two tree braces or standoffs 46, 48 provided adjacent the upper and lower ends 34, 36 of the post 32, respectively. The standoffs 46, 48 may be separate structures from that of the steps 42, 44 or, as illustrated, may be combined as a single structure with each of the steps 42, 44 to yield upper and lower standoff-step components 50, 52.

The at least one step 42 is provided with a mounting collar 54 for attachment to the post 12. More preferably each of the standoff-step components 50, 52 are mounted to the post via respective collars 54, 56. Still more preferably, each of the upper and lower standoff-step components 50, 52 includes as part of its unified structure the collar 54, 56, respectively, for mounting to the post 32. The unified components 50, 52, including the collar portions 54, 56 may be fabricated of a suitable light-weight material such as aluminum and may be precision machined. As illustrated, the collars 54, 56 may be disposed between and join the respective left and right foot pads 42*a*, 42*b* and 44*a*, 44*b*. The standoffs 46, 48 may each have left and right portions, denoted 46*a*, 46*b* and 48*a*, 48*b* that project from a backside of the footpads 42*a*, 42*b* and 44*a*, 44*b*, respectively, and may further engage the collars 54, 56 along their inward edge. The standoffs 46, 48 present rearward-facing jaws 58 that face away and are spaced laterally from the steps 42, 44 and post 32 to define generally V-shaped cradles or braces adjacent the ends 34, 36 of the post 32 for engaging the trunk of a tree and supporting the post 32 and steps 42, 44 and collars 54, 56 in outwardly spaced relation to the tree.

The collars 54, 56 are mounted on the end portions 38, 40 of the post 32. More specifically, the collars 54, 56 are each formed with a bore 60 for receiving the respective end portion 38, 40 into the bore 60. Even more preferably, the ID of bore 60 is dimensioned relative to the OD of the end portions 38, 40 so that the end portions 38, 40 are received with a close fit, and preferably a press fit. The bore 60 is preferably machined and is cylindrical in shape and with a profile that is preferably round in cross section. The collars 54, 56 may be the same length as the thickness of the steps 42, 44 where they join the collars 54, 56. The size of the bores 60 may further take into account the out-of-roundness of the tubing material at the end portions 38, 40 and in achieving the pressfit also reshape the wall of the tubing to conform to the round shape of the bore 60. The bore 60 may be slightly undersized relative to the nominal OD of the end portions. In the example of where the end portions have a nominal OD of about 25.4 mm, the ID of the bore 60 may be 25.3 mm, with the 0.1 mm accommodating for out-of-roundness and achieving a tight friction fit with the OD of the end portions 38, 40. A press may be used to force the collars 54, 56 onto the end portions 38, 40. Once attached, a cross pin 62 may be installed in aligned cross bores through the collars 54, 56 and end portions 38, 40 to provide added strength to the collar-tube joints including in the axial and rotational directions.

Figure 6:
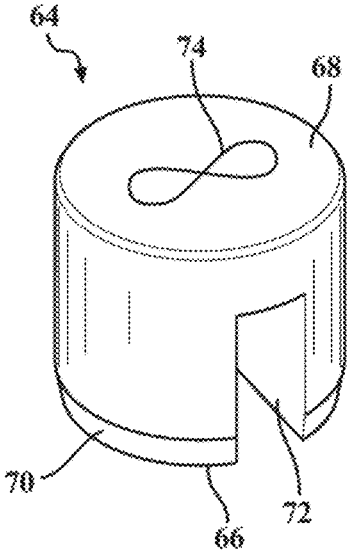
FIG. 6 is an enlarged isometric view of a stabilizing plug according to an embodiment.
Figure 7:
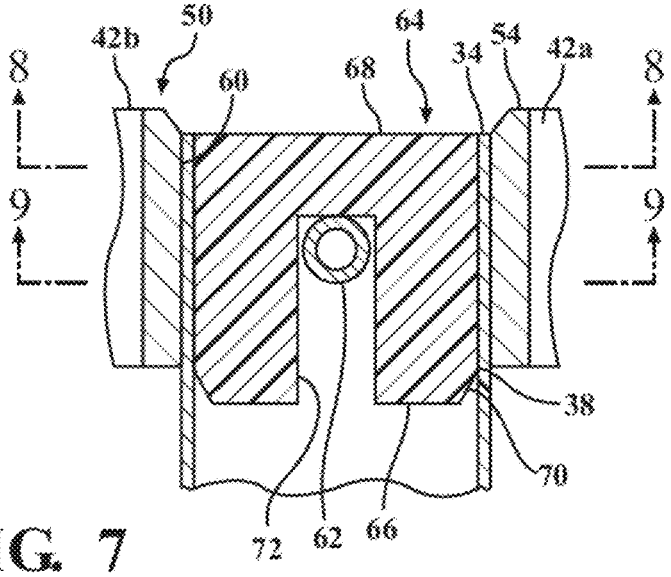
FIG. 7 is an enlarged fragmentary longitudinal cross-sectional of the collar-tube-plug joint shown under a bending load.
Figure 8:
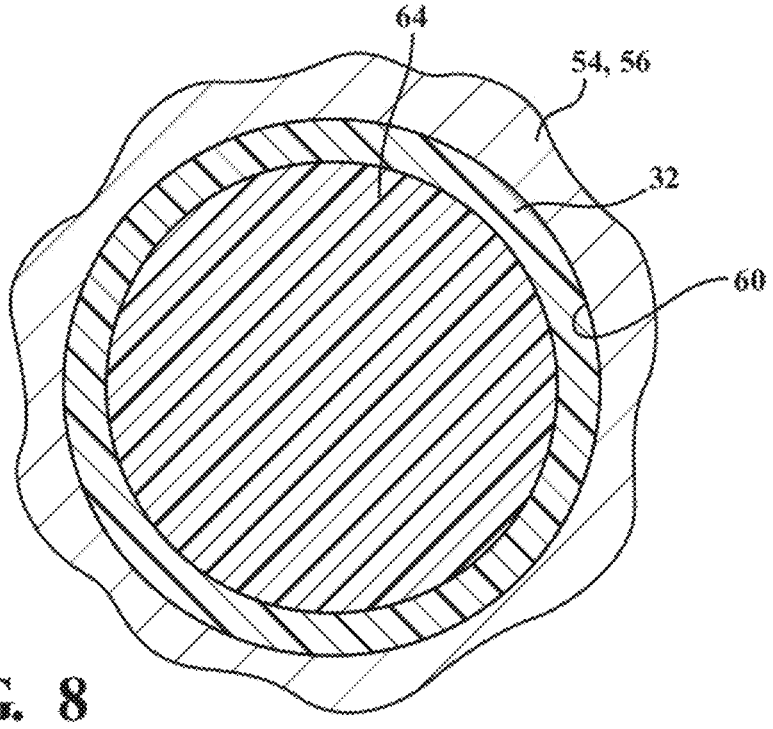
FIG. 8 is a cross-sectional view taken along lines 8-8 of FIG. 7 shown under a bending load.
Figure 9:
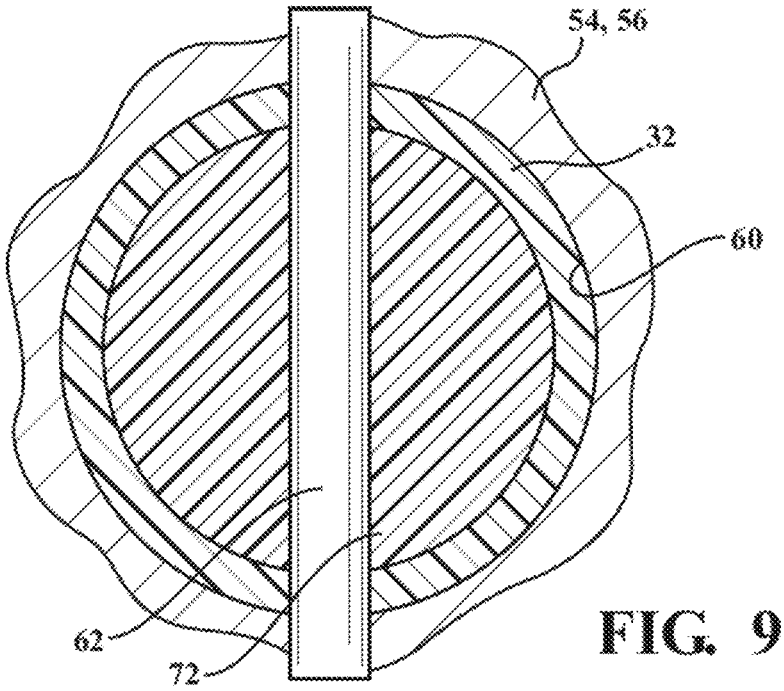
FIG. 9 is a cross-sectional view taken along lines 9-9 of FIG. 7 shown under a bending load.
Figure 10:
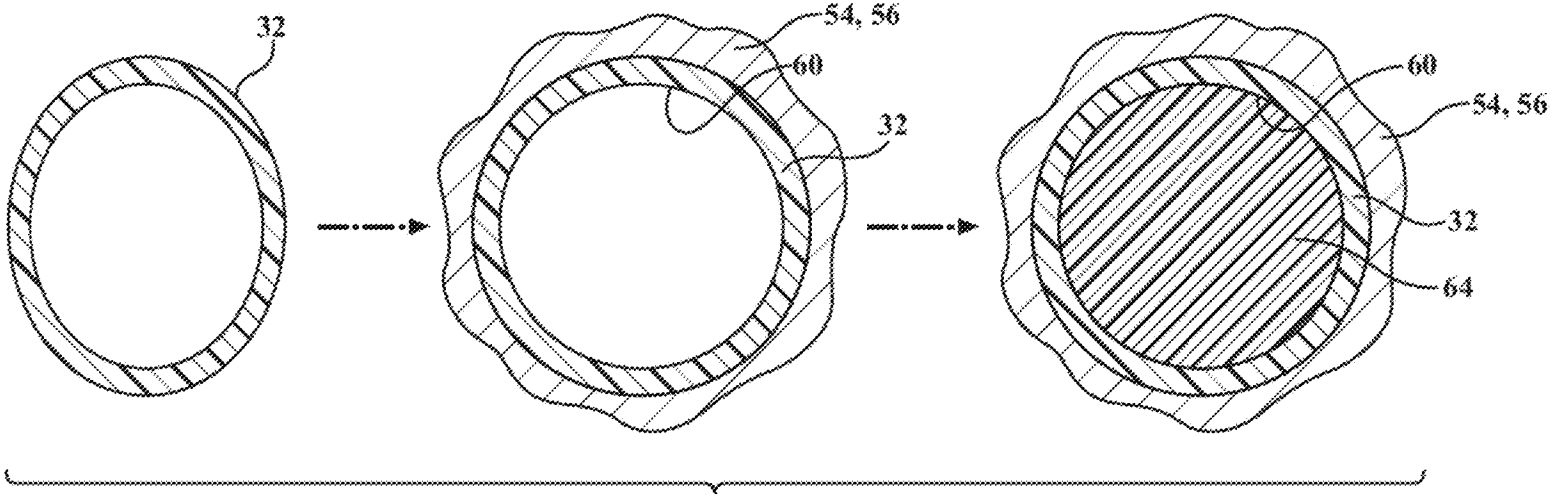
FIG. 10 is a series of enlarged schematic cross-sectional views showing the sequence of shaping and supporting the tubular post to conform to the outer and inner shapes of the collar and stabilizing plug of the joint.

The improved climbing stick 30 further includes at least one and preferably two retention or stabilizing plugs 64 that are disposed in the open end portions 38, 40 of the post 32 as illustrated in FIGS. 6-11. The plugs 64 have an outer surface that compliments the shape of the ID of the collars 54, 56. The plugs 64 are preferably cylindrical in shape on their OD and may be formed of a suitable material such as aluminum. The complimentary cross-sectional shape may be round and is sized to engage the inner wall surface of the end portions 38, 40 with similar tight fit to that achieved on the outer surface of the end portion 38, 40 with the collars 34, 36. The OD of the plugs 64 may be slightly oversized relative to the ID of the end portion wall 38, 40. The size of the plug 64 compliments the size of the collar bores 60 so that the end portions 38, 40 are captured or pinned firmly and immovably between the collars 54, 56 and the plugs 64, preferably with a pressfit connection on both the OD and ID of the end portions 38, 40. This is illustrated in FIGS. 7-9. In the example where the nominal ID of the end portion is 24.6 mm, the OD of the plug may have a dimension of 24.7 mm, with the 0.1 mm accommodating for out-of-roundness of the ID of the end portions 38, 40 and achieving a tight friction fit with the ID of the end portions 38, 40. The plugs 64 are sized and shaped to effectively shape the wall of the end portions 38, 40 from the inside so the wall conforms to the cylindrical shape of the plugs 64 on the inside and to the cylindrical shape of the collar bores 60 on the outside, and both with a tight fit. A press may be used to force the plugs 64 into the end portions 38, 40. FIG. 10 illustrates the sequence of pressing the out-of-round tube 32 into the round bore 60 of the collar 52, 54, followed by pressing the plug 64 into the end of the tube 32 to reshape the tube wall into tight conformance with both the plug 64 and collar bore wall 60. The end portions 38, 40 are thus firmly pinned between the plugs 64 and on the outside by the collars 54, 56 and the plugs 64 support the end portions 38, 40 from flexing inwardly and loosening from the collars 54, 56. The improved climbing stick 30 with plugs 64 may also create an air-free environment or retaining compounds to further strengthen the connections at the joints. Grooves or other pockets or features can also be added to the surfaces of the bores 60 and plugs 64 to accommodate air-curable adhesive without detriment to the fit and integrity of the press-fitted joints. FIG. 14 illustrates such an alternative plug 64''' wherein the outer surface is provided with shallow grooves 65 that are sized to create optimal conditions for a selected binding agent, both as to clearance and surface area, between the plug 64''' and the inner wall of the tube 32 in which it is pressed. The number, size and pattern of the grooves 65 may vary depending upon the requirements of a given application. The plug 64''' may be used in place of plug 64 and may or may not be used in conjunction with a cross pin 62.

The plugs 64 extend axially between an insertion end 66 and an exposed end 68. The plug 64 is preferably solid in cross section over at least part of the length of the collars 54, 56 and more preferably adjacent the insertion end 66. Alternatively, the plugs 64 may be cylindrical but with walls of sufficient thickness, strength and integrity (i.e., hoop strength) to resist any inward flexing of the end portion walls 38, 40 away from the collars 54, 56 that would loosen the joint.

As illustrated in 6, 7 and 9, the plugs 64 may be formed as a separate piece from the collars 54, 56. The plugs 64 may be precision machined from aluminum or other suitable material into a cylindrical shape and may include a chamfer or taper 70 at the insertion end 66 for guidance into and along the open end portions 38, 40 of the post 32. The plugs 64 may be the same length or longer than the length of the collars 54, 56 so that they provide support to the end portions 38, 40 over the full length of the collars 54, 56.

The plugs 64 may further include a cross slot 72 that is open at the insertion end and extending toward the exposed end 68. The cross slot 72 is sized and positioned to receive the cross pin 62 into the slot 72 when the plug 54 is pressed into the respective end portion 38, 40. The slot-to-pin registration or alignment further acts to orient the face of the exposed plug end 68 in an exact rotational orientation relative to the cross pin 62. The exposed end 68 of the plug 64 is preferably solid. The plug 64 is preferable solid in cross section between the exposed end 68 and the cross slot 72, as best illustrated in FIGS. 6 and 7. The exposed end 68 may reside outside of the tube ends 34, 36, but is preferably pressed to be flush or even with the ends 34, 36 so that the plugs 64 are full pressed into and even with the edges of the end portions 38, 40. Advertising indicia 74 such as a company name logo or other information may be provided on the exposed end face 68 and aligned in position relative to the cross pin 62 so that is appears in the same repeatable orientation from product to product. For example, when looking face on to the installed plug 64, the indicia 74 may extend perpendicular to the cross pin 62 or be repeatedly oriented relative to another feature of the assembly. The portions of the plug 64 that extend around and past the pin 62 firmly engage the ID of the end portion in the same manner as the solid portion of the plug 64 above the pin 62. Alternatively, the plug may be solid end-to-end and contain a cross bore instead of a slot, in which case the plug is installed before installation of the pin which is received through the aligned bores of the collar, end portion wall and plug, as best illustrated in FIG. 13.

The orientation of the cross pin 62 and cross bores may be arranged at any orientation relative to the axis of the steps 42, 44, such as perpendicular, as illustrated, parallel, or somewhere in between.

The climbing stick 30 further includes at least one attachment bracket 78 for engaging a rope, cable or strap for removably securing the climbing stick 30 to a tree.

Figure 1:
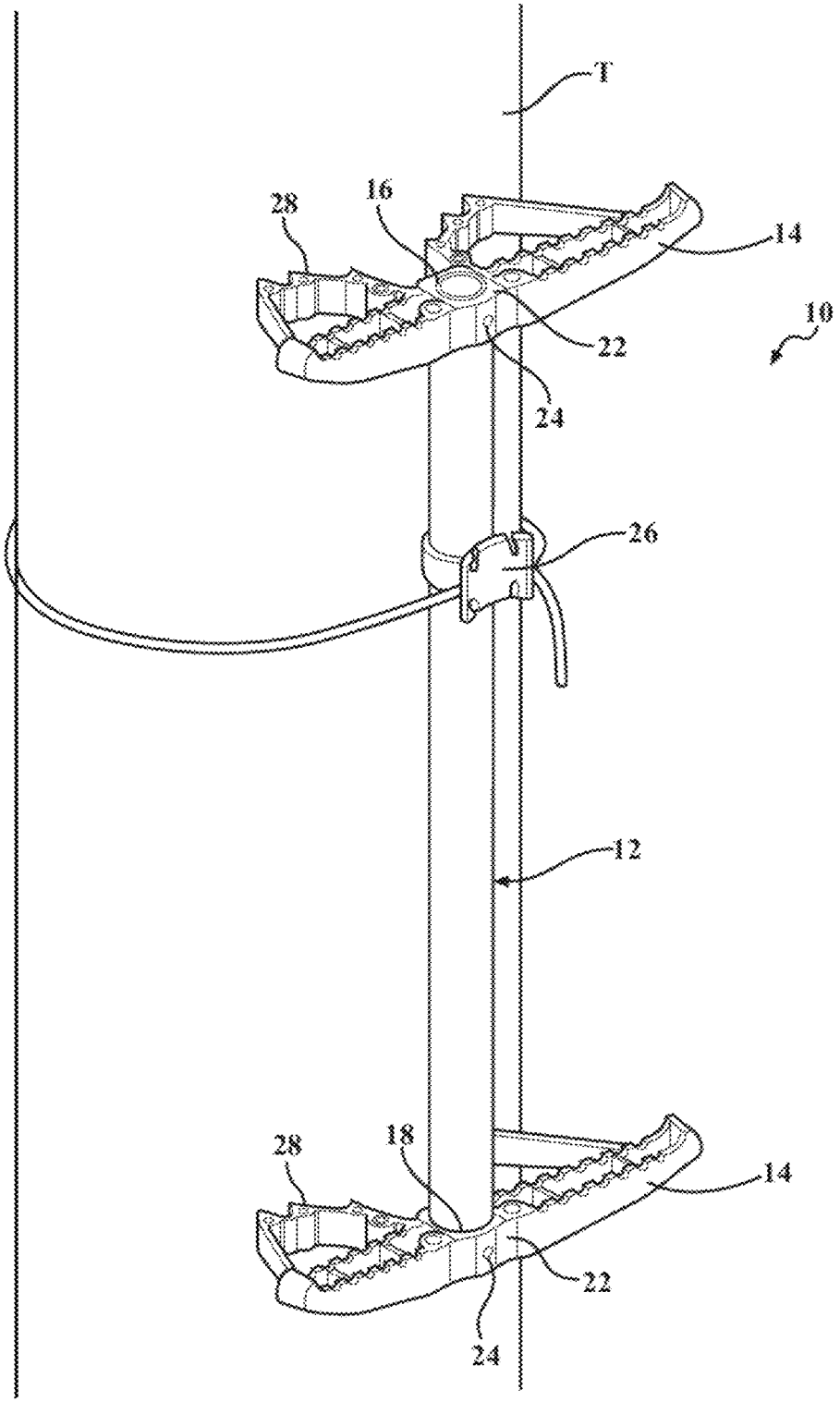
FIG. 1 (Prior Art)
FIG. 1 is a perspective view prior art tree climbing stick.
Figure 2:
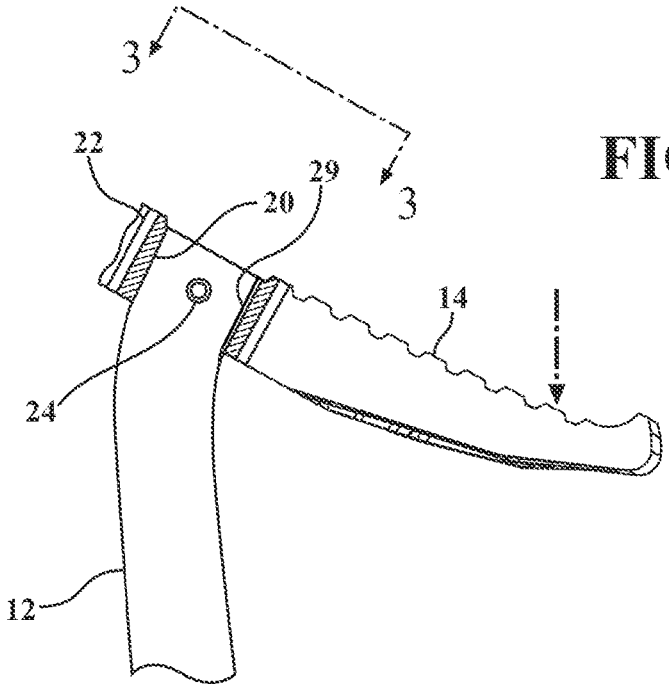
FIG. 2 (Prior Art)
FIG. 2 is a fragmentary cross-sectional view of the upper prior art joint of FIG. 1 shown with an exaggerated tilt of the steps under a bending load.
Figure 3:
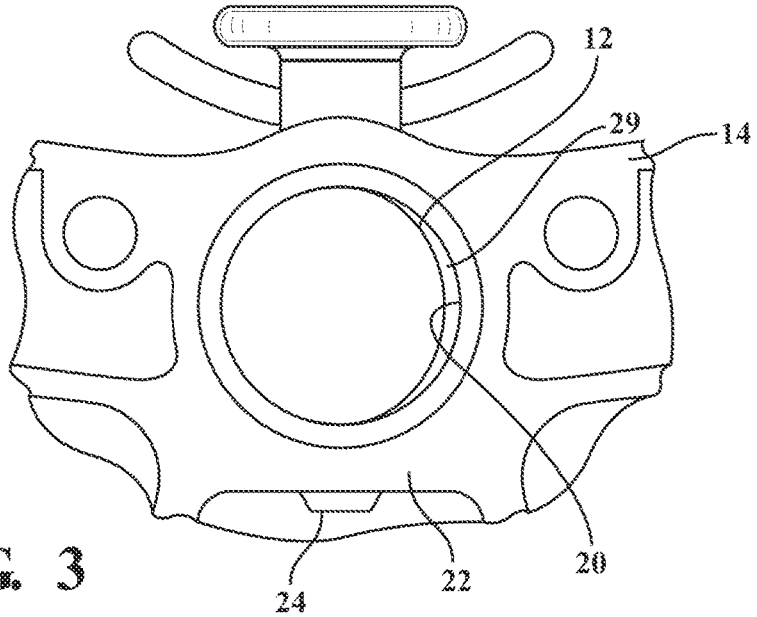
FIG. 3 (Prior Art)
FIG. 3 is an enlarged fragmentary end view of the prior art joint of FIG. 2 looking in the direction of arrows 2-2 showing the wall of the tube flexed inwardly of the collar under the bending load.
Figure 11:
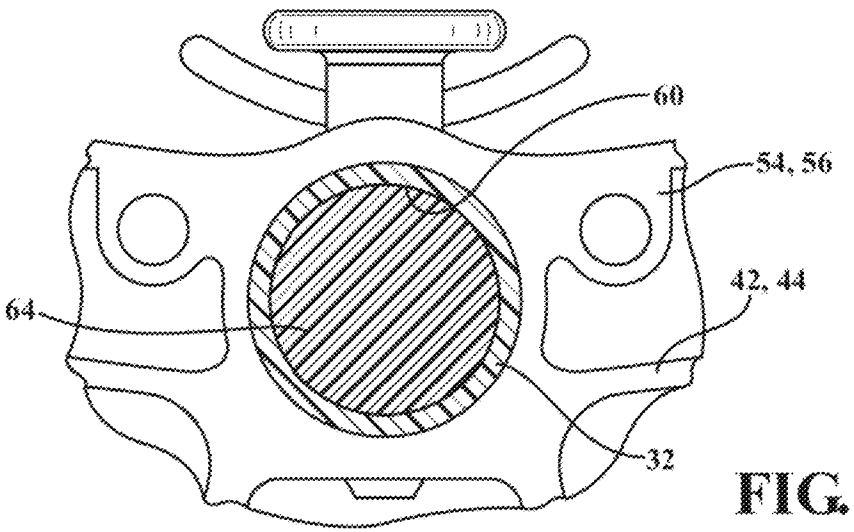
FIG. 11 is an enlarged fragmentary cross-sectional view of an alternative embodiment.

A method of making the climbing stick 30 includes obtaining a length of tubular post 32 material. The collars 54, 56 of the top and bottom components 50, 52 are pressed onto top and bottom end portions 38, 40 of the post 32. The cross pins 62 are installed in the cross bores drilled through the collars 54, 56 and end portions 38, 40. The plugs 64 are pressed into the open ends 34, 36 of the end portions 38, 40 and straddle the cross pins 62 which are received into the slots 72. The plugs 64 close off the open ends of the end portions 38, 40 and support the wall of the end portions 38, 40 from flexing or moving inwardly away from the collars 54, 56. FIG. 11 is a fragmentary top view of the climbing stick 30 with the plug 64 shown sectioned for emphasis. FIG. 11 is a comparable view to the FIG. 3 prior art stick 10, with both showing the sticks 10, 30 under a heavy bending load as was illustrated and described in connection with FIG. 2. In this state, a person may be standing on the upper right-hand step 42 and imparting a concentrated bending load at the collar joint. Unlike FIGS. 2 and 3 of the prior art stick 10, where the wall of the tube flexes inwardly away from the collar and forms a gap 29, the plug 64 of the stick 30 according to the embodiment supports the inside wall of the tube 32 against such inward flexion, keeping the outer surface of the tube 32 tight against the wall of the collar bore 60 and also tight against the outer surface of the plug 64, thereby stabilizing the joint against compromise in the presence of side-to-side bending loads and other forces that may otherwise loosen the tight connection between the collars 54, 56 and tube ends 38, 40. The plug 64 receives and distributes the concentrated bending load that would otherwise cause inward flexing to other parts of the tube, keeping the integrity of the joint intact.

It is contemplated that one may wish to retrofit an existing stick with the reinforcing members 64 into order to prevent loosening of the joints or to stabilize joints that have already been compromised. In such case, one would align the plugs 64 and press or lightly tap the plugs 64 into each open end portion 54, 56, which will tighten the joints and prevent inward flexing of the tube wall within the joint.

FIG. 12 illustrates an alternative embodiment of a climbing stick 30' which may be the same as that described above in connection with embodiment of climbing stick 30 and the features thereof incorporated herein by reference and their corresponding reference characters primed. In the alternative embodiment, the collars 54', 56' and plugs 64' are formed as a single piece rather than separately, defining a circumferential groove 80 between the collar 54', 56' and plug 64' portions into which the end portions 38', 40' are pressfit. A cross pin 62' may be pressed into a cross bore drilled through the collars 54', 56', the end portions 38', 40' and the plugs 64' if desired.

FIG. 13 illustrates another embodiment of a climbing stick 30", wherein the same reference numerals will be used to represent like parts but denoted by double-prime. The stick 30" includes a similar flexible wall tubular post 32" having end portion 54", 56" to which steps 42', 44' are mounted and secured by a fastener 82, such as a threaded bolt and nut, passing through a corresponding opening 84 in the end portion 54", 56". A plug 64" is pressed into the end portions 54", 56" and is provided with an opening 86 that aligns with opening 84 to receive the fastener 82. There may be a single step on the right or left side, or there may be pairs of left and right steps, as illustrated, in each of the upper and lower locations. Where left and right steps are provided, the same fastener 82 may be used to attach both. The right and left steps may be separate parts or unified as a single structure. The fastener stud 82 may be a separate piece from that of the steps 42", 44" or it may be unified as a threaded post.

In use, a person wishing to scale a tree orients the post 32 vertically and cradles the tree in the jaws 58 of the standoffs 46, 48. The strap, rope or cable is extended around the tree and the ends cinched tight and secured to the attachment bracket 76. The user may then climb the stick 30 and repeat the process by placing and securing additional climbing sticks 30 until the desired height is achieved. The weight placed on the steps 42, 44 by the user is transferred to the collars 54, 56 and to the post 32, and the post 32 might bend and flex, but not within the upper and lower collar-plug joints, which are isolated from such flexing and stress by the tight fit of the plugs 64 and collars 54, 56 to the inside and outside of the end portion wall 38, 40. Extended use of the improved climbing stick 30 is possible without loosening of the collar-plug joints.

It is to be understood that the invention may be practiced otherwise than as specifically described while still being within the scope of the invention. The invention is defined by the appended claims.

What is claimed is:

1. A tree climbing stick assembly for use in climbing a tree or pole, comprising:

a central post fabricated of tubular material that is resiliently flexible under a bending load;

at least one step supported on an end portion of the central tubular post; and at least one stabilizing member disposed within the central tubular post in position to support an inner wall of the end portion against inward flexing under the bending load;

wherein each of the at least one stabilizing member and central post does not extend into or around or form a connecting joint with a different central post or stabilizing member of a different tree climbing stick assembly when in use.

2. The assembly of claim 1, wherein the at least one step includes a mounting collar disposed radially opposite the stabilizing member.

3. The assembly of claim 2, wherein the stabilizing member comprises at least one plug formed as a separate piece from the at least one mounting collar.

4. The assembly of claim 3, wherein the plug has a hoop strength that is greater than a hoop strength of the end portion of the tubular post.

5. The assembly of claim 3, wherein the at least one plug has an insertion end and an exposed end, and wherein a slot extends from the insertion end toward and terminates short of the exposed end.

6. The assembly of claim 5, wherein the slot receives a cross pin within the at least one end portion.

7. The assembly of claim 3, wherein the at least one plug includes indicia on an exposed end.

8. The assembly of claim 3, wherein the at least one plug supports the end portion along a full length of the at least one mounting collar.

9. The assembly of claim 5, wherein the at least one plug has a chamfer at the insertion end, the slot extends through the chamfer.

10. The assembly of claim 3, wherein the central post is fabricated of titanium, aluminum, magnesium, steel, fiber-reinforced resin or carbon fiber.

11. The assembly of claim 3, wherein the at least one step comprises a set of upper steps adjacent an upper end of the post and a set of lower steps adjacent a lower end of the post.

12. The assembly of claim 3, wherein the plug includes outer grooves.

13. A tree climbing stick, comprising:

a central post fabricated of tubing extending between upper and lower ends; upper and lower standoff-step components each having a mounting collar mounted about upper and lower end portions of the post;

a cross pin extending through each of the mounting collars and end portions; and a stabilizing plug disposed into each of the end portions to pin each of the end portions between the associated stabilizing plug and collar and to support each of the end portions against flexing within the associated collars;

wherein each of the stabilizing plugs and central post does not extend into or around or form a connecting joint with a different central post or stabilizing plug of a different tree climbing stick when in use.

14. The tree climbing stick of claim 13, wherein the stabilizing plug of each of the end portions includes an inserted end and an exposed end and a slot extending from the inserted end toward the exposed end and receiving the cross pin.

15. The tree climbing stick of claim 14, wherein the inserted end includes a chamfer and the exposed end includes indicia.

16. A method of reinforcing a tree climbing stick that has a flexible tubular central post with steps mounted on upper and lower end portions of the post by mounting collars and cross pins passing through the mounting collars and end portions, wherein the improvement comprises:

aligning a slot open on a bottom of each of two reinforcement plugs lengthwise with the lengthwise direction of the cross pin on each of the respective upper and lower end portions and forcibly inserting the plugs into the end portions so that the bottom of the reinforcement plugs straddle the cross pins and the cross pins are received lengthwise in the slots;

wherein each of the reinforcement plugs and central post does not extend into or around or form a connecting joint with a different central post or reinforcement plug of a different tree climbing stick when in use.

17. The method of claim 16, including providing indicia on an exposed end of the plugs that is oriented in fixed position relative to the slots.

18. The method of claim 17, including providing a chamfer on an insertion end of the plugs.

19. The method of claim 16, wherein the plugs and end portions have an interface end including applying a bonding agent at the interface of the plugs and end portions.

20. The method of claim 16, wherein the plugs are inserted into the end portions of the post to a depth where they do not project longitudinally outward beyond the mounting collars.

21. The method of claim 16, wherein the collars are forced onto the end portions with a press fit and the end plugs are forced into the end portions with a press fit radially opposite the collars to tightly pin the end portions radially between the collars and the plugs.

* * * * *